US006683572B2

(12) United States Patent
Abe et al.

(10) Patent No.: US 6,683,572 B2
(45) Date of Patent: Jan. 27, 2004

(54) CHIP ANTENNA DEVICE AND METHOD

(75) Inventors: Masaaki Abe, Urawa (JP); Makoto Fujita, Yokohama (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/111,546

(22) PCT Filed: Aug. 28, 2001

(86) PCT No.: PCT/EP01/09996

§ 371 (c)(1),
(2), (4) Date: Apr. 24, 2002

(87) PCT Pub. No.: WO02/19464

PCT Pub. Date: Mar. 7, 2002

(65) Prior Publication Data

US 2002/0154062 A1 Oct. 24, 2002

(30) Foreign Application Priority Data

Aug. 30, 2000 (JP) ..... 2000-260096

(51) Int. Cl.[7] ..... H01Q 1/38; H01Q 1/24

(52) U.S. Cl. ..... 343/700 MS; 343/702; 343/873

(58) Field of Search ..... 343/700 MS, 702, 343/873, 846, 848; H01Q 1/38, 1/24

(56) References Cited

U.S. PATENT DOCUMENTS

| | | | | |
|---|---|---|---|---|
| 5,588,198 A | | 12/1996 | Kawahata et al. | 29/600 |
| 6,028,568 A | * | 2/2000 | Asakura et al. | 343/895 |
| 6,281,848 B1 | * | 8/2001 | Nagumo et al. | 343/700 MS |
| 6,549,167 B1 | * | 4/2003 | Yoon | 343/700 MS |

FOREIGN PATENT DOCUMENTS

| | | | |
|---|---|---|---|
| EP | 0766340 A2 | 2/1997 | H01Q/9/04 |

* cited by examiner

*Primary Examiner*—Hoanganh Le
(74) *Attorney, Agent, or Firm*—Gregory L. Thorne

(57) ABSTRACT

The invention provides an antenna device 1 that is small in its size but wide in its bandwidth. The recess 2*a* is formed in the dielectric substrate 2. The shorting electrode 5 is formed on the front surface 2*d* of the substrate 2 for connecting radiation electrode 3 to each of grounding electrodes 6, 7.

16 Claims, 3 Drawing Sheets

CHIP ANTENNA DEVICE AND METHOD

TECHNICAL FIELD

The invention relates to an antenna device comprising a radiation electrode that extends two-dimensionally. The invention further relates to a printed circuit board and to a mobile radio apparatus

BACKGROUND OF THE INVENTION

As mobile communication equipments such as mobile radio apparatus, e.g. telephones have been commonly used, their size needs to be made smaller. In recent years, in order to meet this requirement, chip type antennas, for example, have been developed for the mobile communication equipments.

Since a chip antenna can be rather small in comparison with a monopole type antenna, the mobile communication equipment itself can be also made smaller by use of the chip antenna. On the other hand, however, there exists a problem that the bandwidth of the chip antenna may become narrow due to the small size of the antenna.

Accordingly, it is an object of the invention to provide an antenna device that is small in its size but wide in its bandwidth.

SUMMARY OF THE INVENTION

In order to achieve the above-described object, the invention provides an antenna device comprising a substrate and a radiation electrode which extends two-dimensionally and is formed on a surface of or inside the substrate wherein the substrate has a hollow part or a recess.

The hollow part or recess formed in the substrate provides an effect of widening the bandwidth of the antenna device.

Especially, the substrate for the antenna device in accordance with the invention preferably contains a dielectric material or a magnetic material. Either dielectric material or magnetic material may be used as a material for the substrate depending on the applications. In particular, the dielectric material can provide an antenna that has a favorable high frequency characteristic.

Besides, the antenna device in accordance with the invention is preferably constructed in such manner that a recess extending from a front surface to a rear surface of the substrate is formed in a lower surface of the substrate, first and second grounding electrodes are formed respectively on both sides of that portion of the lower surface of the substrate where the recess is formed, and an shorting electrode is formed on one of the front surface and the rear surface of the substrate for connecting the radiation electrode to each of the first and second grounding electrodes.

With the shorting electrode as formed above, the bandwidth of the antenna device can be further widened.

DETAILED DESCRIPTION OF THE INVENTION

Figure 1:
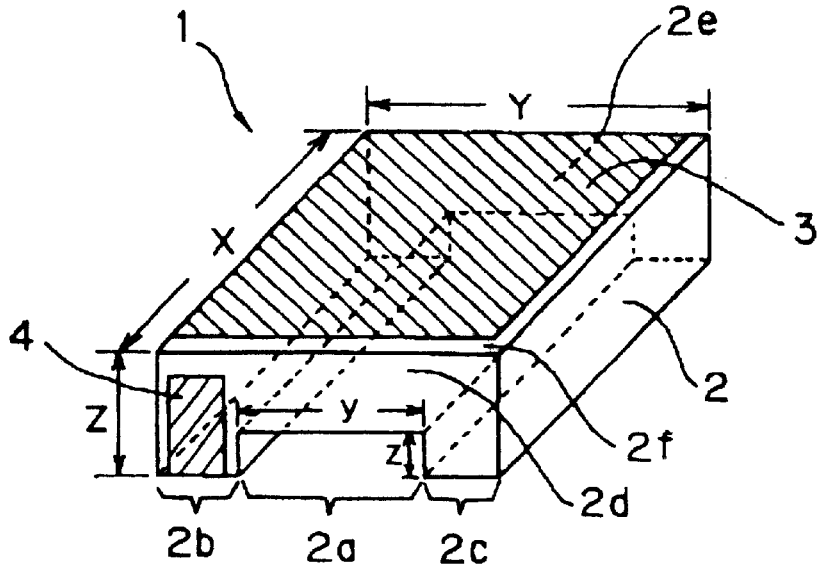
FIG. 1 is a front-side perspective of an antenna device in accordance with one embodiment of the invention.
Figure 2:
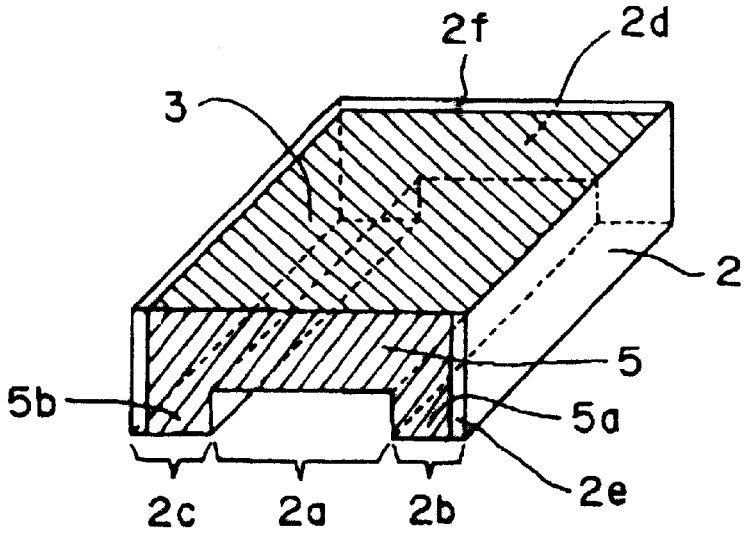
FIG. 2 is a rear-side perspective of the antenna device shown in FIG. 1.
Figure 3:
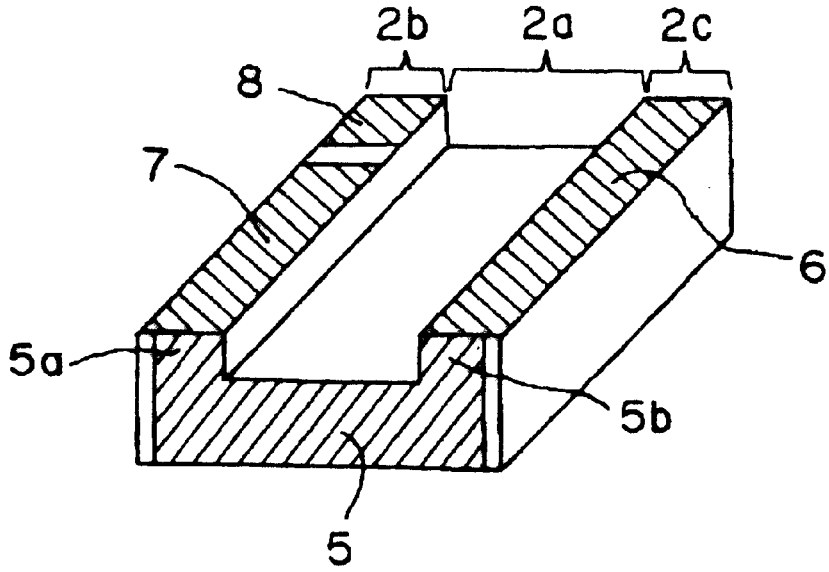
FIG. 3 is a rear-side perspective of the same antenna device being placed upside-down.

FIG. 1 is a front-side perspective view of an antenna device in accordance with one embodiment of the invention, FIG. 2 is a rear-side perspective view of the antenna device shown in FIG. 1, and FIG. 3 is a rear-side perspective view of the same antenna device being placed upside-down.

The antenna device 1, as shown in FIG. 1, comprises a dielectric substrate 2 that mainly contains such a dielectric material as ceramic. In a lower surface of this dielectric substrate, a recess 2*a* is formed which extends from a front surface 2*d* to a rear surface 2*e* of the dielectric substrate (see FIG. 3), so that projections 2*b* and 2*c* projecting relative to the recess 2*a* are formed on both sides of the recess 2*a*.

Besides, a radiation electrode 3 in a rectangle shape is formed on the upper surface 2*f* of the dielectric substrate 2. Furthermore, as shown in FIG. 3, a grounding electrode 6 is formed on a lower-surface of one projection 2*c*, and another grounding electrode 7 and a lower-surface feeding electrode 8 are formed in a lower surface of the other projection 2*b*. The grounding electrode 7 and the lower-surface feeding electrode 8 are located separately each other. Besides, a front-surface feeding electrode 4 is formed on the projection 2*b* side of the front surface 2*d* as shown in FIG. 1. This front-surface feeding electrode 4 is connected to the lower-surface feeding electrode 8 shown in FIG. 3. Yet, a shorting electrode, which is connected to the radiation electrode 3, is formed on the rear surface 2*e* of the dielectric substrate 2 as shown in FIG. 2. This shorting electrode extends from the projection 2*b* side to the projection 2*c* side within the rear surface 2*e* of the dielectric substrate 2. One end portion 5*a* on the projection 2*b* side of the shorting electrode 5 is connected to the grounding electrode 7 and the other end portion 5*b* on the projection 2*c* side of the shorting electrode 5 is connected to the grounding electrode 6 (see FIG. 3).

Such constructed antenna device 7 is a chip type antenna device that has been constructed by forming electrodes 3, 4, 5, 6, 7 and 8 on the dielectric substrate 2. With such chip type structure, the size of the antenna device 1 could be reduced.

Moreover, in this antenna device 1, the recess 2*a* is formed in the dielectric substrate 2. This recess 2*a* contributes to widening the bandwidth of the antenna device 1. Besides, in this embodiment, the shorting electrode is connected to both of the grounding electrodes 6 and 7 rather than only one of those two grounding electrodes 6 and 7. The frequency bandwidth can be further widened by providing with such structure of connection to both of the two grounding electrodes 6 and 7 in comparison with the structure of connection to only one of the two grounding electrodes 6 and 7. However, as long as a desired frequency bandwidth can be obtained, the structure of connection of the shorting electrode 5 to only one of the two grounding electrodes 6 and 7 may be allowed.

In this embodiment, the antenna device 1 is provided with the dielectric substrate 2 that mainly contains the ceramic material. However, it should be noted that the antenna device 1 may be provided with a magnetic substrate that mainly contains a magnetic material (for example, a ferrite material) instead of the dielectric substrate 2. In the case of providing the antenna device 1 with the magnetic substrate instead of dielectric substrate 2, it is possible to widen the frequency bandwidth of the antenna device by forming a recess (groove) in the magnetic substrate.

Furthermore, in this embodiment, the recess 2*a* of the dielectric substrate 2 is formed so as to extend from the front surface 2*d* to the rear surface 2*e*. However, there is no need to form the recess 2*a* in the shape of extending from the front surface 2*d* to the rear surface 2*e*, and the shape of the recess 2*a* may vary depending on the usage of the antenna device 1. Besides, although this embodiment provides the recess 2*a* in the dielectric substrate 2 in order to widen the frequency bandwidth, a hollow part may be alternatively used rather than the recess. The hollow part can equivalently serve to widen the frequency bandwidth of the antenna device 1.

It should be also noted that the invention should not be limited to the aforementioned embodiment and that various changes to the aforementioned embodiment may be possible.

Figure 4:
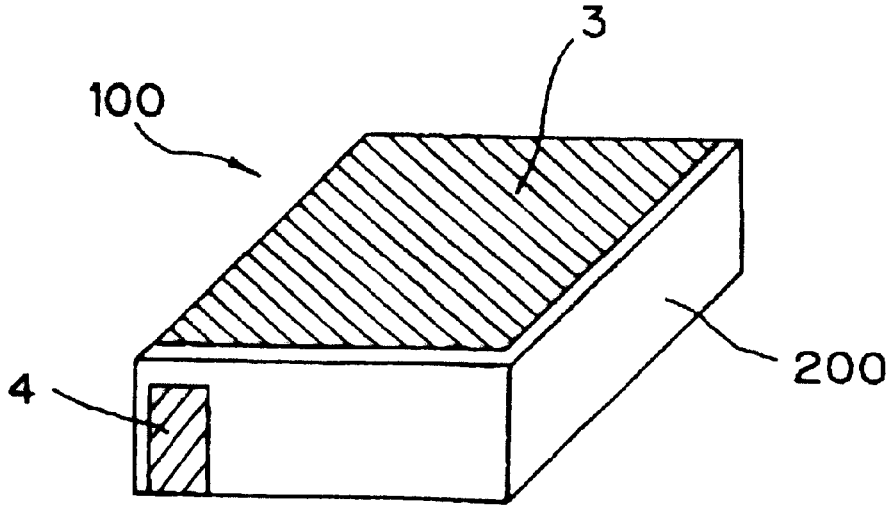
FIG. 4 is a perspective of a conventional antenna device.

One embodiment example of the antenna device according to the present invention is explained below. In this embodiment example, the antenna device 1 having the structure shown in FIG. 1 is used. The permittivity $\epsilon$ of the dielectric substrate 2 of the antenna device 1 in this embodiment example is approximately equal to 20. As for the dimension of the antenna device 1, the length X, width Y and height Z of the dielectric substrate 2 shown in FIG. 1 are 9 mm, 6 mm and 2 mm respectively, and the width y and depth z of the recess 2*a* are 4 mm and 1 mm respectively (the length of the recess 2*a* is 9 mm, which is equal to the length X of the dielectric substrate 2). FIG. 4 illustrates an antenna device 100 as an example for comparison. The differences between the antenna device 1 as the embodiment example and the antenna device 100 as the comparison example are that the dielectric substrate 2 of the antenna device 1 as the embodiment example comprises the recess 2*a* whereas the dielectric substrate 200 of the antenna device 100 as the comparison example does not comprise such recess but is formed in a rectangular solid, and that a grounding electrode for the antenna device 100 as the comparison example is formed almost all over the lower surface of the dielectric substrate 200.

Figure 5:
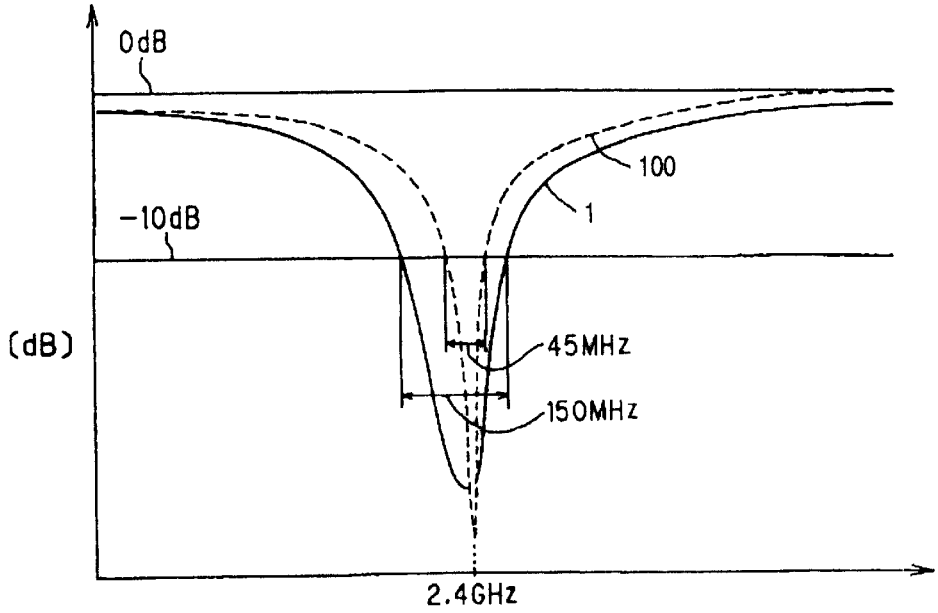
FIG. 5 is a graph for showing the comparison of frequency characteristics between an antenna device 1 of an embodiment of the invention and a conventional antenna device 100.

FIG. 5 shows frequency characteristics of the antenna device 1 as the embodiment example and the antenna device 100 as the comparison example. The solid line represents the frequency characteristic of the antenna device 1 as the embodiment example and the broken line represents the frequency characteristic of the antenna device 100 as the comparison example. As seen in FIG. 5, both center frequencies for the embodiment example and the comparison example lie in 2.4 GHz. However, on the −10 dB line, the bandwidth of the antenna device 100 as the comparison example is 45 MHz while that of the antenna device 1 as the embodiment example is 150 MHz, which means that the bandwidth in the embodiment example has been widened about three times in comparison with the comparison example.

Consequently, the invention can contribute to providing an antenna device that is small in its size but wide in its bandwidth.

What is claimed is:

1. A method for making a chip type antenna having a wide bandwidth, comprising the steps of:

forming a recess extending from a front end surface to a rear end surface in a bottom portion of a substrate that contains a dielectric material or a magnetic material;

forming a radiation electrode on a top portion of said substrate;

forming a first grounding electrode on a portion of a first segment of the bottom portion of said substrate adjacent one side of said recess, leaving a gap on said first bottom segment between an extended end of said grounding electrode and said front end surface;

forming a second grounding electrode on a portion of a second segment of said bottom portion of said substrate adjacent another side of said recess;

forming a first portion of a feeding electrode on said first segment of the bottom portion of said substrate between said front end surface and said gap, said gap being between terminating ends of said first grounding electrode and said feeding electrode;

forming a second portion of said feeding electrode on the front end surface of said substrate adjacent said first segment of the bottom portion of said substrate; and forming a shorting electrode on the rear end surface of said substrate for electrically connecting said radiation electrode to at least one of said first and second grounding electrodes.

2. The method of claim 1, further including the step of:

forming said shorting electrode for electrically connecting both of said first and second grounding electrodes to said radiation electrode.

3. The method of claim 2, wherein the length, width, and height of said substrate are 9 millimeters, 6 millimeters, and 2 millimeters, respectively, the width and depth of said recess are 4 millimeters and 1 millimeter, respectively, and the length of said recess is 9 millimeters.

4. The method of claim 2, further including the step of mounting said chip type antenna on a printed circuit board.

5. The method of claim 2, further including the step of mounting said chip type antenna in a mobile TV radio apparatus.

6. The method of claim 3, wherein the length, width, and height of said substrate are 9 millimeters, 6 millimeters, and 2 millimeters, respectively, the width and depth of said recess are 4 millimeters and 1 millimeter, respectively, and the length of said recess is 9 millimeters.

7. The method of claim 2, further including the step of mounting said chip type antenna on a printed circuit board.

8. The method of claim 1, further including the step of including said chip type antenna in a mobile TV radio apparatus.

9. A chip type antenna having a wide bandwidth, comprising:

a substrate that contains a dielectric material or a magnetic material;

said substrate having a recess extending from a front end surface to a rear end surface in a bottom portion;

a radiation electrode on a top portion of said substrate;

a first grounding electrode on a portion of a first segment of the bottom portion of said substrate adjacent one side of said recess, leaving a gap on said first bottom segment between an extended end of said first grounding electrode and said front end surface;

a second grounding electrode on the a portion of a second segment of said bottom portion of said substrate adjacent another side of said recess;

a first portion of a feeding electrode on said first segment of the bottom portion of said substrate between said front end surface and said gap, said gap being between terminating ends of said first grounding electrode and said feeding electrode;

a second portion of said feeding electrode on the front end surface of said substrate adjacent said first segment of the bottom portion of said substrate; and a shorting electrode on the rear end surface of said substrate for electrically connecting said radiation electrode to at least one of said first and second grounding electrodes.

10. The antenna of claim 9, further including:

said shorting electrode electrically connecting both of said first and second grounding electrodes to said radiation electrode.

11. The antenna of claim 10, wherein the length, width, and height of said substrate are 9 millimeters, 6 millimeters, and 2 millimeters, respectively, the width and depth of said recess are 4 millimeters and 1 millimeter, respectively, and the length of said recess is 9 millimeters.

12. The antenna of claim 10, further including mounting said chip type antenna on a printed circuit board.

13. The antenna of claim 10, further including the step of including said chip type antenna in a mobile TV radio apparatus.

14. The antenna of claim 9, wherein the length, width, and height of said substrate are 9 millimeters, 6 millimeters, and 2 millimeters, respectively, the width and depth of said recess are 4 millimeters and 1 millimeter, respectively, and the length of said recess is 9 millimeters.

15. The antenna of claim 9, further including mounting said chip type antenna on a printed circuit board.

16. The antenna of claim 9, further including the step of including said chip type antenna in a mobile TV radio apparatus.

* * * * *